US010159325B2

(12) United States Patent
Seo

(10) Patent No.: US 10,159,325 B2
(45) Date of Patent: Dec. 25, 2018

(54) CASE FOR LIQUID LIPSTICK AND LIP GLOSS

(71) Applicant: JEONG HUN CO., LTD., Bucheon (KR)

(72) Inventor: Jeung Seok Seo, Bucheon (KR)

(73) Assignee: JEONG HUN CO., LTD., Bucheon-si (KR)

( * ) Notice: Subject to any disclaimer, the term of this patent is extended or adjusted under 35 U.S.C. 154(b) by 0 days.

(21) Appl. No.: 14/768,781

(22) PCT Filed: Jun. 2, 2015

(86) PCT No.: PCT/KR2015/005538
§ 371 (c)(1),
(2) Date: Aug. 19, 2015

(87) PCT Pub. No.: WO2016/108357
PCT Pub. Date: Jul. 7, 2016

(65) Prior Publication Data

US 2018/0184784 A1 Jul. 5, 2018

(30) Foreign Application Priority Data

Jan. 2, 2015 (KR) ..... 10-2015-0000054

(51) Int. Cl.

| | |
|---|---|
| ***B43K 21/08*** | (2006.01) |
| ***A45D 34/04*** | (2006.01) |
| ***A45D 40/06*** | (2006.01) |
| ***B65D 83/00*** | (2006.01) |

(52) U.S. Cl.
CPC ..... *A45D 34/04* (2013.01); *A45D 40/06* (2013.01); *A45D 40/065* (2013.01); *B65D 83/00* (2013.01); *B65D 83/0005* (2013.01); *B65D 83/0011* (2013.01)

(58) Field of Classification Search
CPC .. A45D 40/06; A45D 40/065; B65D 83/0005; B65D 83/0011
USPC ..... 401/68, 75
See application file for complete search history.

(56) References Cited

U.S. PATENT DOCUMENTS

| | | | | |
|---|---|---|---|---|
| 6,688,317 | B2 * | 2/2004 | Gueret | A45D 40/26 132/320 |
| 7,201,526 | B2 * | 4/2007 | Tani | A45D 40/04 222/390 |
| 7,377,707 | B2 * | 5/2008 | Breidenbach | A45D 34/04 401/11 |

FOREIGN PATENT DOCUMENTS

| | | |
|---|---|---|
| JP | 2011-142945 | 7/2011 |
| KR | 10-2003-0015539 | 2/2003 |
| KR | 10-2005-0072658 | 7/2005 |
| KR | 20-2014-0004843 | 8/2014 |

* cited by examiner

*Primary Examiner* — Jennifer C Chiang
(74) *Attorney, Agent, or Firm* — Lex IP Meister, PLLC

(57) ABSTRACT

A liquid lipstick container includes an applicator of which surface is subjected to flocking to improve the applicability of liquid lipstick and has symmetric application holes to uniformly apply the liquid lipstick.

6 Claims, 5 Drawing Sheets

- Prior Art -

CASE FOR LIQUID LIPSTICK AND LIP GLOSS

CROSS REFERENCE TO RELATED APPLICATION

The present application claims priority to Korean Patent Application No. 10-2015-0000054, Jan. 2, 2015, the entire contents of which is incorporated herein for all purposes by this reference.

BACKGROUND OF THE INVENTION

1. Field of the Invention

The present invention generally relates to a liquid lipstick container. More particularly, the present invention relates to a liquid lipstick container, in which an applicator is further mounted in a receiving part to improve the applicability of liquid lipstick, application holes are formed in the applicator in such a way as to be symmetric with respect to a center so that a user may uniformly apply the liquid lipstick, and a surface of the container is subjected to flocking.

2. Description of the Related Art

Generally, lipstick, lip gloss, lip balm, or the like are substances that people put on their lips.

Here, lipstick is mainly used to make the lips colored, lip gloss is transparent or glossy and is mainly used to make the lips shiny, and lip balm is balm (sweet smelling oil) that is applied to the lips, is principally composed of wax or petroleum jelly ingredients, and is mainly used to prevent lips from becoming chapped or split.

Of course, there are various lip cosmetics including lip tint or the like as well as lipstick, lip gloss, and lip balm. Lip cosmetics are typically separated into a solid-type lipstick and a gel-type lip gloss according to the purpose of applying makeup to the lips.

Solid-type lipstick expresses color and is long lasting, whereas lip gloss is a moist product used to protect lips from becoming dry or to provide a glossy look to the lips, and is frequently re-applied on the lipstick.

Hence, the current cosmetic market is researching and developing liquid lipstick contents that possess all of the following: color expressing ability, lasting ability, and a glossy look.

Meanwhile, solid lipstick is a form that is widely known to people. A lipstick container for the solid lipstick, which is capable of adjusting a use amount while rotating the solid lipstick, has been developed. However, the container for liquid lipstick that is currently used has only been manufactured in the form of a simple tube. Such a liquid lipstick container was disclosed in detail in Korean U.M. Registration No. 20-0361601.

As shown in FIG. 1, a conventional liquid lipstick container includes a tube container 100 that holds liquid lipstick therein, a protector 200 that protects the tube container 100, a nozzle tip 300 coupled to a front end of the tube container 100 and having a discharge hole 301, and a cap 400 protecting the nozzle tip 300.

The conventional liquid lipstick container discharges the liquid lipstick to the discharge hole 301 via force generated by the user pressing the tube container 100 with his/her fingers, whereby the discharged makeup can be applied to the user's lips by placing nozzle tip 300 in contact with his/her lips.

However, the conventional liquid lipstick container is problematic in that a discharge amount should be adjusted by simply pressing the tube container, so that an excessively large amount may be discharged with a little force if a large amount of liquid lipstick is in the tube container, and the liquid lipstick may not be discharged if a small amount of lipstick is in the tube container, thus causing inconvenience to the user.

Further, the conventional liquid lipstick container is problematic in that the liquid lipstick is not uniformly discharged, and a surface coming into contact with the lips is in the form of a closed surface, so that the liquid lipstick should be reciprocated several times or pressurized to be evenly applied to the lips.

SUMMARY OF THE INVENTION

Accordingly, the present invention has been made keeping in mind the above problems occurring in the related art, and an object of the present invention is to provide a liquid lipstick container, including a feeding part that applies uniform pressure to liquid lipstick to discharge it when the feeding part is rotated, thus improving the applicability of the liquid lipstick contained in the container and allowing the liquid lipstick to be uniformly applied, and an applicator that has a plurality of application holes and is treated at a surface thereof by flocking, thus making it easy to apply the discharged liquid lipstick to the lips.

In order to achieve the above object, according to an aspect of the present invention, there is provided a liquid lipstick container, including a receiving part receiving liquid lipstick therein, and having on an upper portion thereof a discharge hole to discharge the liquid lipstick to outside; a feeding part including a piston coming into close contact with an inner circumference of the receiving part to move up and down, a feeding shaft having on an outer circumference thereof a male screw to cause the piston to move up and down, and a seat extending from a lower end of the feeding shaft so that the receiving part is seated thereon; a lower body including a fixing portion provided on a lower inner circumference to be fixed to an outer circumference of the seat, and a protecting portion extending upwards from the fixing portion in an enveloping manner so that portions of the receiving part and the feeding part are inserted therein; and an upper body coupled to the lower body to surround an outer circumference of an upper portion of the lower body and protect an upper portion of the receiving part, wherein a mounting portion is provided on an upper end of the discharge hole such that an applicator improving applicability of the liquid lipstick is mounted thereto.

The applicator may include an extension hole formed therethrough to pass through the discharge hole, a plurality of application holes formed through a location under the extension hole to be symmetric with each other with respect to a center, and fluff provided on a surface of the applicator, with fine powder being attached to the fluff to improve the applicability.

The applicator may include an extending coupler, the extending coupler protruding downwards to allow the extension hole to pass through the discharge hole and being coupled to a back thereof.

The mounting portion may include a rotation preventing step that is formed by elevating a side of the mounting portion upwards to prevent the applicator from being rotated leftwards or rightwards, and the applicator may include a step support to correspond to the rotation preventing step.

The piston may include a pressurizing end provided on an upper end thereof to pressurize the liquid lipstick towards the discharge hole, and a feeding hole formed in a center thereof and having a female screw to correspondingly engage with the male screw, and the pressurizing end may include a contact plate that may be formed along an outer circumference of an upper surface of the piston and may protrude upwards diagonally to come into close contact with an inner circumference of the receiving part.

The lower body may include on an inner circumference of a lower portion thereof a locking protrusion to prevent a removal of the receiving part during rotation, and the receiving part may include on an outer circumference of a lower portion thereof a locking groove that corresponds to the locking protrusion.

The upper body may include a leak preventer inserted into the extension hole to prevent the liquid lipstick from leaking out when the upper body may be coupled with the lower body.

As described above, the liquid lipstick container according to the present invention has the following effects.

First, an applicator is provided on an upper end of a receiving part and has an extension hole connected to a discharge hole, and a plurality of application holes is formed to allow liquid lipstick to be uniformly applied, in addition to the extension hole that is in the form of simply extending an opening, thus improving the applicability of the liquid lipstick.

Second, a piston coming into close contact with an inner circumference of a receiving part to be moved up and down is coupled to a lower body and is moved up and down relative to a feeding shaft as the lower body rotates, thus allowing the liquid lipstick in the receiving part to be stably discharged.

Third, the applicator is provided with an extending coupler coupled to a back of the discharge hole, thus connecting the extension hole and the discharge hole with each other and thereby preventing liquid lipstick from leaking out through a connecting joint.

Fourth, a rotation preventing step and a step support are correspondingly provided on a mounting portion and an applicator, and thereby the inclination of the applicator is fixed to correspond to the surface of the lip, thus allowing the liquid lipstick to be uniformly applied.

Fifth, the surface of an applicator is subjected to flocking, so that it is possible to finely adjust liquid lipstick applied to the lips, and it is possible to replace the applicator with another one depending on the kind of the liquid lipstick, thus significantly improving applicability.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Hereinafter, a preferred embodiment according to the present invention will be described in detail with reference to the accompanying drawings.

Figure 1:
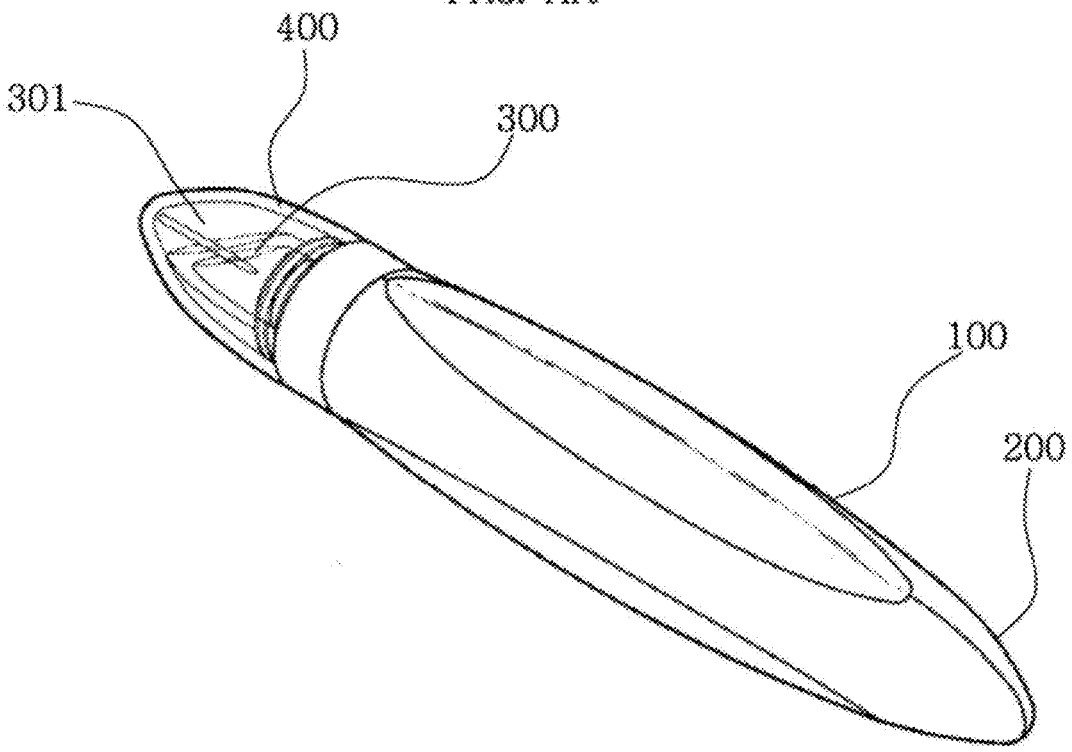
FIG. 1 is a perspective view illustrating a conventional liquid lipstick container.
Figure 2:
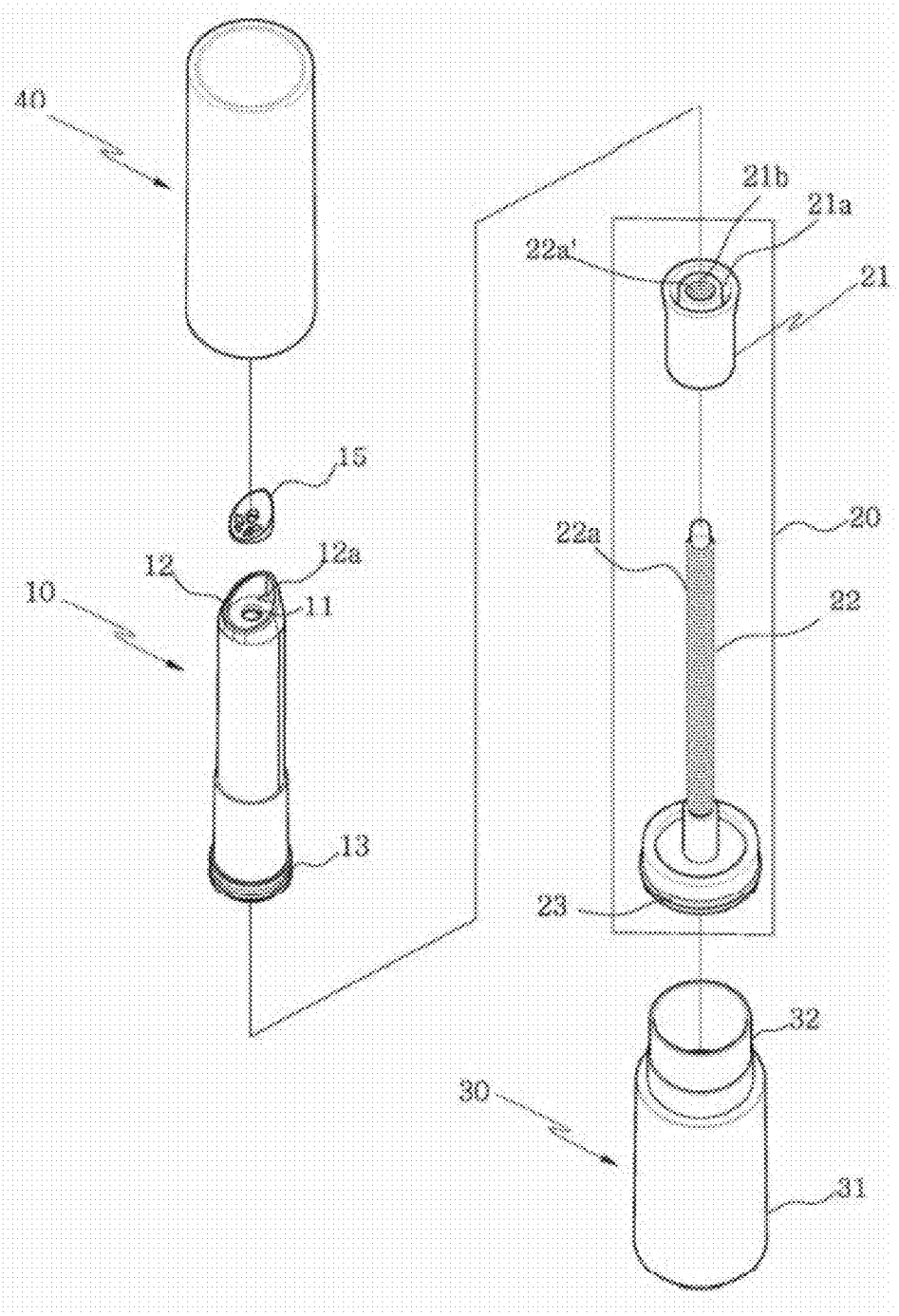
FIG. 2 is an exploded perspective view illustrating a liquid lipstick container according to the present invention.
Figure 3:
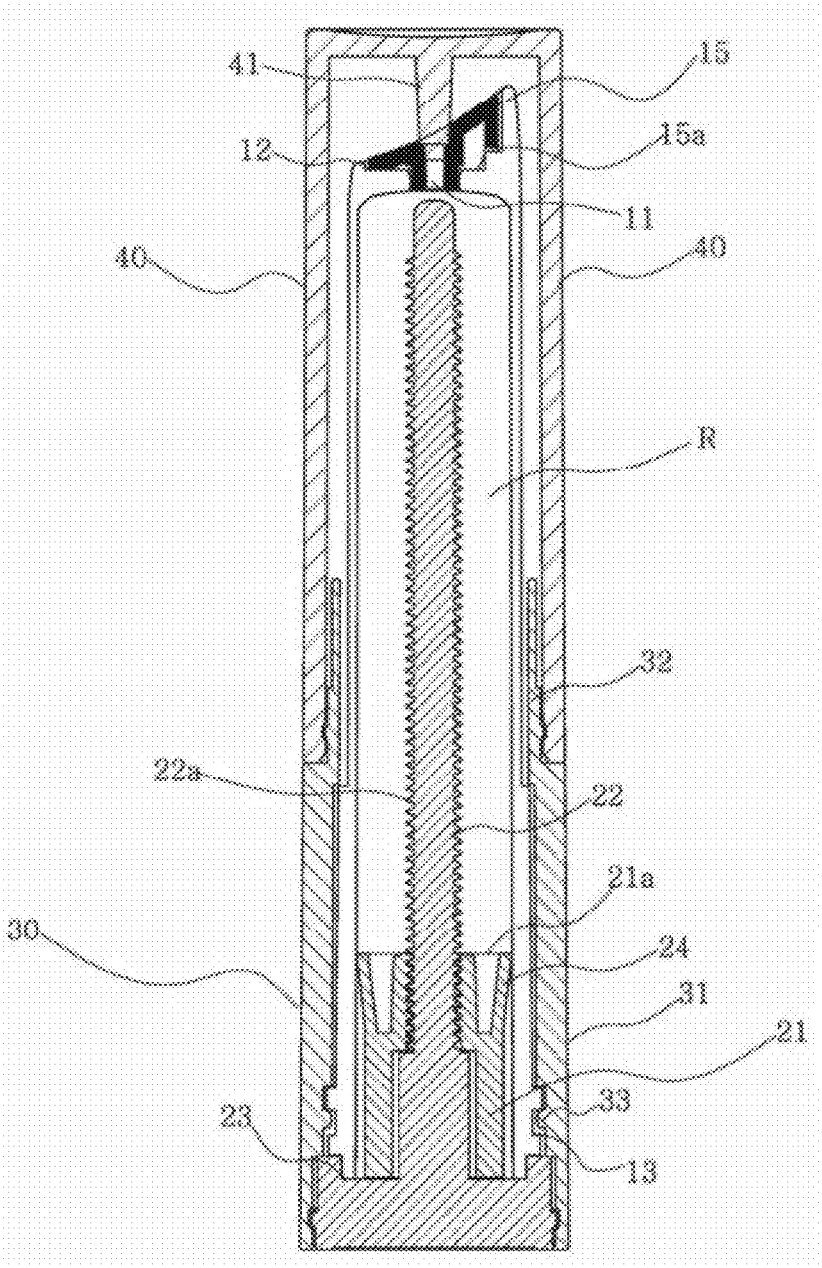
FIG. 3 is a sectional view illustrating the liquid lipstick container according to the present invention.

As shown in FIG. 2, a liquid lipstick container according to the present invention is equipped with an applicator 15 to improve applicability. The liquid lipstick container includes a receiving part 10, a feeding part 20, a lower body 30, and an upper body 40. The receiving part 10 receives liquid lipstick R therein, and has on an upper portion thereof a discharge hole 11 to discharge the liquid lipstick to outside. The feeding part 20 includes a piston 21 that comes into close contact with an inner circumference of the receiving part 10 to move up and down, a feeding shaft 22 that has on an outer circumference thereof a male screw 22*a* to cause the piston 21 to move up and down, and a seat 23 that extends from a lower end of the feeding shaft 22 so that the receiving part 10 is seated thereon. The lower body 30 includes a fixing portion 31 that is provided on a lower inner circumference to be fixed to an outer circumference of the seat 23, and a protecting portion 32 that extends upwards from the fixing portion 31 in an enveloping manner so that portions of the receiving part 10 and the feeding part 20 are inserted therein. The upper body 40 is coupled to the lower body 30 to surround an outer circumference of an upper portion of the lower body 30 and protect an upper portion of the receiving part 10.

Here, a mounting portion 12 is provided on an upper end of the discharge hole 11 such that an applicator 15 improving applicability of the liquid lipstick R is mounted thereto.

Figure 4:
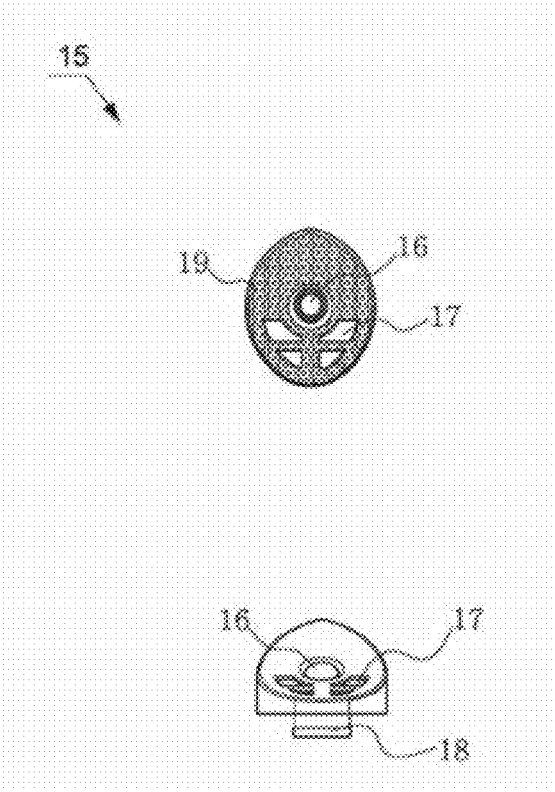
FIG. 4 illustrates an applicator of the liquid lipstick container according to the present invention in a plan view and a front view.

Further, as shown in FIG. 4, the applicator 15 includes an extension hole 16 that is formed therethrough to pass through the discharge hole 11, and a plurality of application holes 17 that is formed through a location under the extension hole 16 to be symmetric with each other with respect to a center.

Furthermore, fluff 19 is provided on a surface of the applicator 15, with fine powder being attached to the fluff 19 to improve the applicability. Thus, it is possible to delicately adjust the amount of liquid lipstick that is to be applied to the lips. Preferably, the fluff 19 is formed by flocking the entire surface of the applicator 15.

In addition, the applicator 15 is made of a silicone material to improve a feel when it comes into contact with the lips. Preferably, the applicator 15 is inclined from a peripheral region towards a central portion to easily come into contact with the lips that are curved surfaces.

Further, the applicator 15 includes an extending coupler 18. The extending coupler 18 protrudes downwards to allow the extension hole 16 to pass through the discharge hole 11 and is coupled to a back thereof.

Meanwhile, the mounting portion 12 includes a rotation preventing step 12*a* that is formed by elevating a side of the mounting portion 12 upwards to prevent the applicator 15 from being rotated leftwards or rightwards, and the applicator 15 includes a step support 15*a* to correspond to the rotation preventing step 12*a*.

Further, the piston 21 includes a pressurizing end 21*a* provided on an upper end thereof to pressurize the liquid lipstick R towards the discharge hole 11, and a feeding hole

21*b* formed in a center thereof and having a female screw 22*a*' to correspondingly engage with the male screw 22*a*.

The pressurizing end 21*a* includes a contact plate 24 that is formed along an outer circumference of an upper surface of the piston 21 and protrudes upwards diagonally to come into close contact with an inner circumference of the receiving part 10.

The lower body 30 includes on an inner circumference of a lower portion thereof a locking protrusion 33 to prevent the removal of the receiving part 10 during rotation. The receiving part 10 includes on an outer circumference of a lower portion thereof a locking groove 13 that corresponds to the locking protrusion 33.

The upper body 40 includes a leak preventer 41 that is inserted into the extension hole 16 to prevent the liquid lipstick R from leaking out when the upper body 40 is coupled with the lower body 30.

That is, the leak preventer 41 prevents the liquid lipstick R from leaking out from the extension hole 16 and the discharge hole 11 coupled to the extension hole 16.

Next, the operation of the liquid lipstick container according to the present invention configured as described above will be described.

Figure 5:
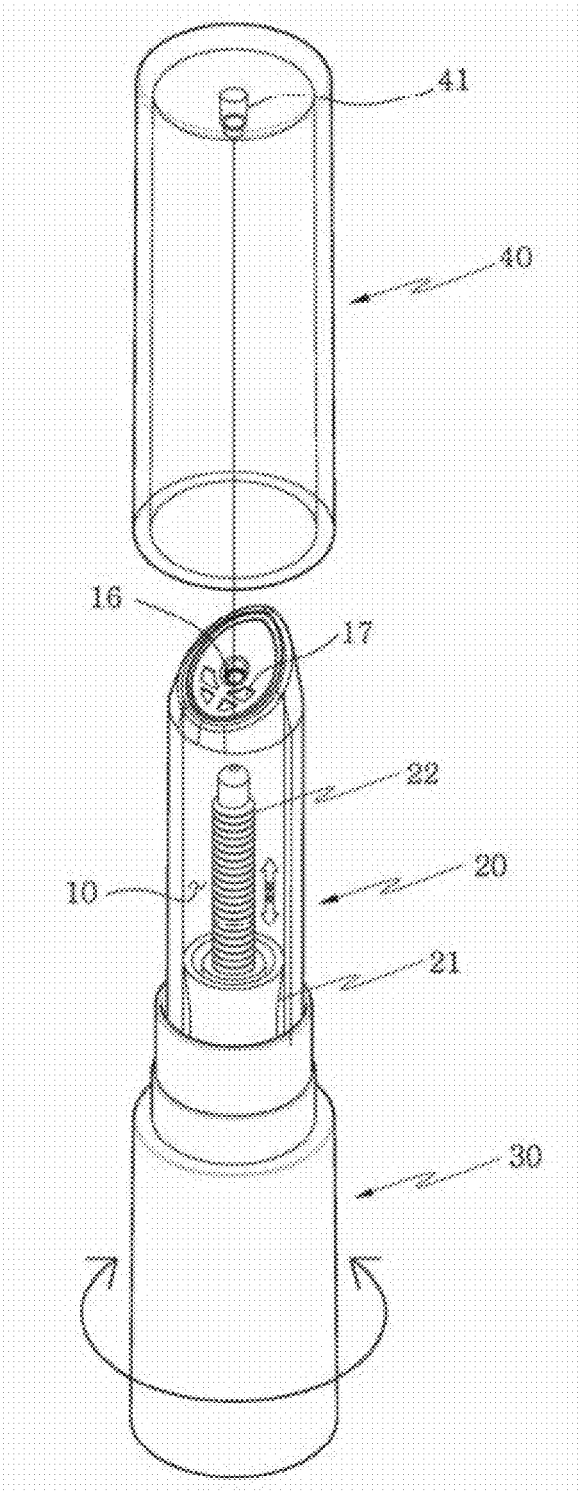
FIG. 5 is a perspective view illustrating an operation of the liquid lipstick container according to the present invention.

As shown in FIG. 5, the liquid lipstick container according to the present invention separately includes the applicator 15 that is formed on the upper end of the receiving part 10 by flocking treatment, thus improving the applicability and allowing the lipstick to be stably applied when the liquid lipstick R held in the container is applied to the lips.

To be more specific, the piston 21, which comes into close contact with the inner circumference of the receiving part 10 and pressurizes to discharge the liquid lipstick R upwards, has on the central portion thereof the female screw 22*a*', so that the rotary motion of the lower body 30 causes the piston 21 to move up and down along the feeding shaft 22. In other words, the rotary motion is converted into the rectilinear motion to allow the piston to be stably moved up and down.

Moreover, the feeding part 20 having the piston 21, the feeding shaft 22, and the seat 23 is inserted into the lower body 30, so that the piston 21 comes into close contact with the inner circumference of the receiving part 10 to move up and down when the lower body 30 rotates.

In this regard, the lower body 30 is provided with the fixing portion 31 to be fixedly coupled to the outer circumference of the seat 23. The fixing portion 31 serves to transmit the rotation of the lower body 30.

Further, the upper body 40 is coupled to the upper portion of the lower body 30 to prevent the liquid lipstick R from being directly exposed to the outside and thereby being contaminated.

In addition to the structure of stably discharging the liquid lipstick R as such, the applicator 15 is provided on the upper end of the receiving part 10, thus allowing a user to apply the liquid lipstick R with the improved applicability due to the extension hole 16 connected to the discharge hole 11 and the plurality of application holes 17 formed around the extension hole 16.

Here, the application holes 17 are formed to be symmetric with each other with respect to the center, thus allowing a user to intuitively uniformly apply the liquid lipstick R.

In addition, the extending coupler 18 protrudes downwards from the extension hole 16, so that the extending coupler 18 is bound to the back of the discharge hole 11 and forms a duct for stably discharging the liquid lipstick R.

Further, the applicator 15 has on a side thereof the step support 15*a*, so that the step support 15*a* is coupled to the rotation preventing step 12*a* provided on the mounting portion 12, thus preventing the applicator 15 from rotating leftwards or rightwards when the liquid lipstick R is applied.

Further, the piston 21 has the contact plate 24 that diagonally comes into close contact with the inner circumference of the receiving part 10, so that the liquid lipstick R is held in the receiving part 10.

That is, the contact plate 24 constitutes a portion of the pressurizing end 21*a* and serves to press the liquid lipstick R to the discharge hole 11.

Further, the leak preventer 41 provided on the upper body 40 is inserted into the extension hole 16 to prevent the liquid lipstick R from leaking out.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A liquid lipstick container, comprising:

a receiving part receiving liquid lipstick therein, and having on an upper portion thereof a discharge hole to discharge the liquid lipstick to outside;

a feeding part comprising:

a piston coming into close contact with an inner circumference of the receiving part to move up and down;

a feeding shaft having on an outer circumference thereof a male screw to cause the piston to move up and down; and a seat extending from a lower end of the feeding shaft so that the receiving part is seated thereon;

a lower body comprising:

a fixing portion provided on a lower inner circumference to be fixed to an outer circumference of the seat; and a protecting portion extending upwards from the fixing portion in an enveloping manner so that portions of the receiving part and the feeding part are inserted therein; and an upper body coupled to the lower body to surround an outer circumference of an upper portion of the lower body and protect an upper portion of the receiving part, wherein a mounting portion is provided on an upper end of the discharge hole such that an applicator improving applicability of the liquid lipstick is mounted thereto, and wherein the applicator comprises:

an extension hole formed therethrough to pass through the discharge hole;

a plurality of application holes formed through a location under the extension hole to be symmetric with each other with respect to a center; and fluff provided on a surface of the applicator, with fine powder being attached to the fluff to improve the applicability.

2. The liquid lipstick container as set forth in claim 1, wherein the applicator comprises an extending coupler, the extending coupler protruding downwards to allow the extension hole to pass through the discharge hole and being coupled to a back thereof.

3. The liquid lipstick container as set forth in claim 2, wherein the mounting portion comprises a rotation preventing step that is formed by elevating a side of the mounting portion upwards to prevent the applicator from being rotated leftwards or rightwards, and the applicator comprises a step support to correspond to the rotation preventing step.

4. The liquid lipstick container as set forth in claim 1, wherein the piston comprises:

a pressurizing end provided on an upper end thereof to pressurize the liquid lipstick towards the discharge hole; and a feeding hole formed in a center thereof and having a female screw to correspondingly engage with the male screw, wherein the pressurizing end comprises a contact plate that is formed along an outer circumference of an upper surface of the piston and protrudes upwards diagonally to come into close contact with an inner circumference of the receiving part.

5. The liquid lipstick container as set forth in claim 1, wherein the lower body comprises on an inner circumference of a lower portion thereof a locking protrusion to prevent a removal of the receiving part during rotation, and the receiving part comprises on an outer circumference of a lower portion thereof a locking groove that corresponds to the locking protrusion.

6. The liquid lipstick container as set forth in claim 1, wherein the upper body comprises a leak preventer inserted into the extension hole to prevent the liquid lipstick from leaking out when the upper body is coupled with the lower body.

* * * * *